US009202426B2

(12) United States Patent
Lin et al.

(10) Patent No.: US 9,202,426 B2
(45) Date of Patent: Dec. 1, 2015

(54) DISPLAY DRIVING CIRCUIT AND DRIVING METHOD OF DISPLAY UNIT

(75) Inventors: Feng-Sheng Lin, Hsin-Chu (TW); Chun-Chi Lai, Hsin-Chu (TW); Kuo-Hsing Cheng, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 510 days.

(21) Appl. No.: 13/615,520

(22) Filed: Sep. 13, 2012

(65) Prior Publication Data

US 2013/0249924 A1 Sep. 26, 2013

(30) Foreign Application Priority Data

Mar. 23, 2012 (TW) ..... 101110158 A

(51) Int. Cl.
*G09G 3/36* (2006.01)
*G09G 3/34* (2006.01)

(52) U.S. Cl.
CPC ..... *G09G 3/3651* (2013.01); *G09G 3/344* (2013.01); *G09G 2300/0473* (2013.01); *G09G 2310/0245* (2013.01); *G09G 2310/063* (2013.01); *G09G 2320/0257* (2013.01); *G09G 2320/048* (2013.01); *G09G 2320/0606* (2013.01)

(58) Field of Classification Search
None
See application file for complete search history.

(56) References Cited

U.S. PATENT DOCUMENTS 8,035,611 B2 10/2011 Sakamoto
2007/0057905 A1 3/2007 Johnson et al.
2007/0285693 A1* 12/2007 Kim et al. ..... 358/1.9
2010/0073277 A1* 3/2010 Lee et al. ..... 345/107
2010/0309193 A1 12/2010 Sun et al.
2012/0039512 A1 2/2012 Tsai et al.

FOREIGN PATENT DOCUMENTS

| | | |
|---|---|---|
| CN | 1797140 | 7/2006 |
| CN | 101615374 | 12/2009 |
| CN | 101645239 | 2/2010 |
| TW | 201005703 A | 2/2010 |
| TW | 201044346 A | 12/2010 |
| TW | 201208384 A | 2/2012 |

OTHER PUBLICATIONS

Taiwan Patent Office "Office Action Notice" for TW application No. 101110158 (counterpart foreign application under examination) dated Nov. 12, 2014.
SIPO First Notice of Opinion on Examination for Chinese patent application No. 201210136822.3 mailed on Dec. 31, 2013.

* cited by examiner

*Primary Examiner* — James A Thompson
(74) *Attorney, Agent, or Firm* — Ding Yu Tan

(57) ABSTRACT

A driving method of a display unit includes: executing a first display procedure, for displaying a first frame on a display unit of the display driving circuit, and executing a counting mechanism; determining, if a second display procedure for displaying a second frame on the display unit is confirmed to be executed, whether or not a counting value of the counting mechanism is larger than a predetermined value; sequentially executing a specific display procedure and the second display procedure if the counting value is larger than the predetermined value; and directly executing the second display procedure if the counting value is equal to or smaller than the predetermined value. A display driving circuit applicable to be used by the display unit is also provided.

19 Claims, 7 Drawing Sheets

DISPLAY DRIVING CIRCUIT AND DRIVING METHOD OF DISPLAY UNIT

TECHNICAL FIELD

The present disclosure relates to a driving circuit and a driving method, and more particularly to a display driving circuit applicable to use with a display unit and a driving method of the display unit.

BACKGROUND

Compared with other types of current displays, electrophoretic display, due to having low-power consumption, readability, etc. is getting popular with consumers in recent years. Although the electrical power is consumed only while the frame switching is being performed, the electrophoretic display, due to the insulating solvent may limit the movement speed of charged color particles, and therefore still has the ghost issue; in other words, the previous frame is still shown while the current frame is being displayed. In particular, the ghost issue is getting serious if the previous frame has a relatively long displaying time.

SUMMARY

The disclosure provides a driving method of a display unit, which includes: executing a first display procedure, for displaying a first frame on the display unit, and executing a counting mechanism; determining, if a second display procedure for displaying a second frame on the display unit is confirmed to be executed, whether or not a counting value of the counting mechanism is larger than a predetermined value; sequentially executing a specific display procedure and the second display procedure if the counting value is larger than the predetermined value; and directly executing the second display procedure if the counting value is equal to or smaller than the predetermined value.

The disclosure further provides a display driving circuit, which includes a gate drive unit, a source drive unit, a display unit and a timing control unit. The gate drive unit is configured to provide at least a scan signal. The source drive unit is configured to provide at least a data signal. The display unit is electrically coupled to the gate drive unit and the source drive unit and configured to display a corresponding frame according to the scan signal(s) and the data signal(s). The timing control unit is electrically coupled to the source drive unit and configured to control the source drive unit to provide the data signal(s), execute a first display procedure for displaying a first frame on the display unit and execute a counting mechanism. The timing control unit is further configured to determine, before a second display procedure for displaying a second frame on the display unit is confirmed to be executed, whether or not a counting value of the counting mechanism is larger than a predetermined value. The timing control unit is further configured to sequentially execute a specific display procedure and the second display procedure if the counting value is larger than the predetermined value. The timing control unit is further configured to directly execute the second display procedure if the counting value is equal to or smaller than the predetermined value.

The disclosure still further provides driving method of a display unit, which includes: displaying a first image; accumulating a counting value when a first image is being displayed; and delivering a compensating signal when the counting value is larger than a predetermined value.

To sum up, because a specific frame(s) (for example, a previous frame, a full-white frame and/or a full-black frame) is inserted and displayed while the display unit is performing an image switching, the driving method and the display driving circuit according to the present disclosure can avoid the ghost issue and consequently have an improved display quality.

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
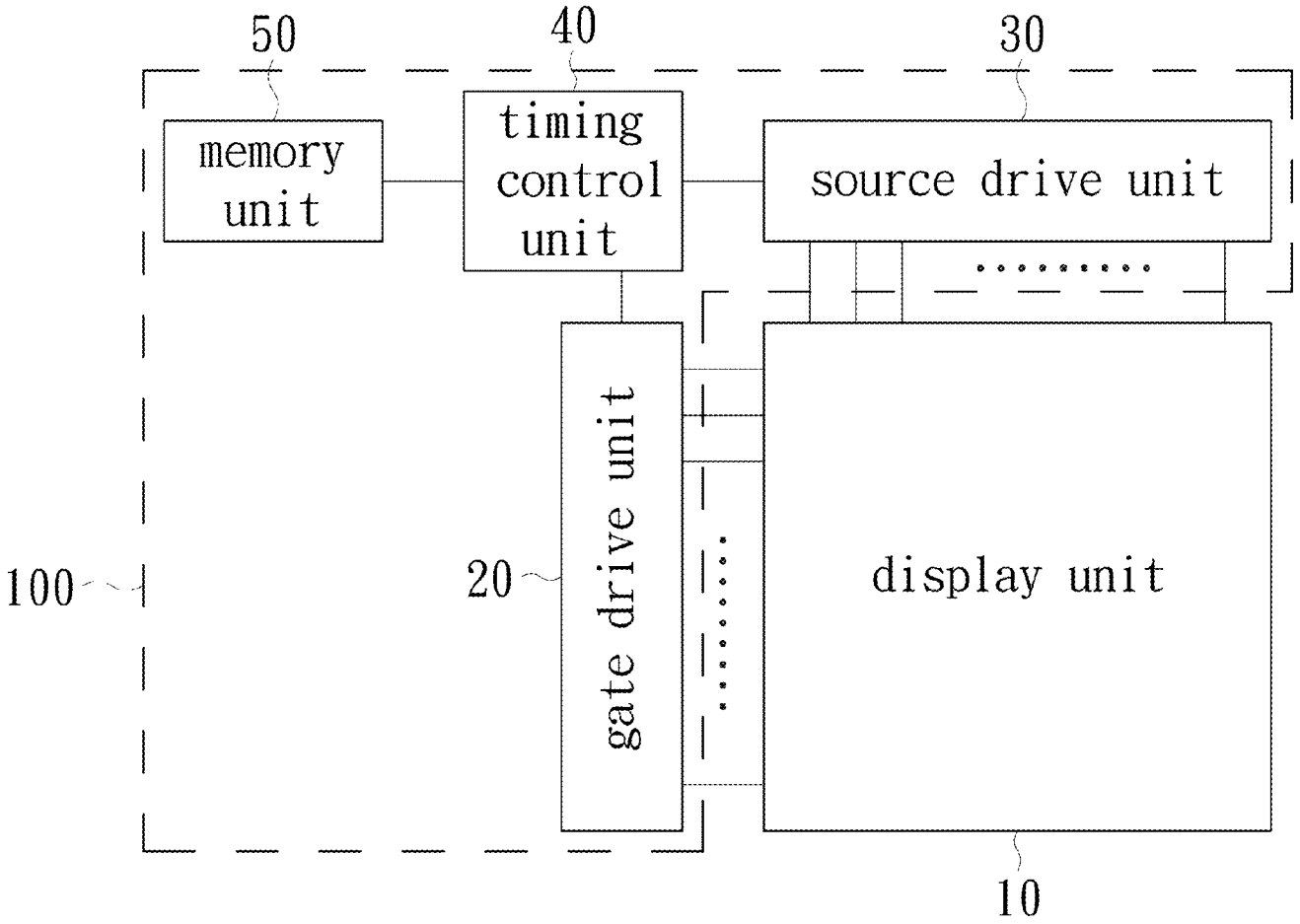
FIG. 1 is a schematic block view of a display driving circuit in accordance with an embodiment of the present disclosure.

FIG. 1 is a schematic block view of a display driving circuit in accordance with an embodiment of the present disclosure. As shown, the display driving circuit 100 in this embodiment, applicable to use with a display unit 10, includes a gate drive unit 20, a source drive unit 30, a timing control unit 40 and a memory unit 50.

The display unit 10 includes a plurality of pixel circuits (not shown), a power supply circuit (not shown) and/or an optical module (not shown). Each pixel circuit is constituted by a thin film transistor (TFT), a liquid crystal capacitor and a storage capacitor. The display unit 10 is a bi-stable display, and no limitation.

The gate drive unit 20 is electrically coupled to the display unit 10 and configured to provide, through a plurality of scan lines (not designated in FIG. 1), a plurality of scan signals to the display unit 10 so as to sequentially switch-on or switch-off the TFTs in the display unit 10 in a row-by-row manner.

The source drive unit 30 is electrically coupled to the display unit 10 and configured to provide, through a plurality of data lines (not designated in FIG. 1), a plurality of data signals to the display unit 10 so as to charge or discharge the pixel circuits in the display unit 10. In other words, through being electrically coupled to the gate drive unit 20 and the source drive unit 30 and from which respectively receiving at least one scan signal and at least one data signal, the display unit 10 can display a corresponding frame.

The timing control unit 40 is electrically coupled to the gate drive unit 20 and the source drive unit 30. The timing control unit 40 is configured to control the time sequence of the data signals provided from the source drive unit 30 to the display unit 10. In particular, the timing control unit 40 in this embodiment is further configured to execute a counting mechanism along with a first display procedure, which is for displaying a frame P1 (shown in FIG. 2A) on the display unit 10. In addition, the timing control unit 40, before the execution of a second display procedure which is for displaying another frame (for example, the frame P2 shown in FIG. 2A) on the display unit 10, is configured to determine whether or not a counting value derived from the counting mechanism is larger than a predetermined value. In particular, the predetermined value can be adjusted or updated by a user through a human-machine interface (not shown).

In this embodiment, if the counting value is larger than the predetermined value, the timing control unit 40 firstly executes a specific display procedure SF (shown in FIG. 2A) before the execution of the second display procedure which is for displaying the frame P2 on the display unit 10. Alternatively, the timing control unit 40 directly executes the second display procedure without the execution of the specific display procedure SF if the counting value is equal to or smaller than the predetermined value.

As shown in FIG. 1, the memory unit 50 is electrically coupled to the timing control unit 40 and configured to store the frame data of the frames P1, P2. Therefore, the timing control unit 40 can control the display unit 10 to display the frames P1, P2 according to the frame data stored in the memory unit 50. In addition, the memory unit 50 is further configured to store a plurality of control parameter sets. The timing control unit 40 can output the required control signals to the source drive unit 30 and/or the gate drive unit 20 through a reference or conversion of the control parameter sets stored in the memory unit 50. The memory unit 50 is implemented with a volatile memory or a non-volatile memory, and no limitation.

Figure 2A:
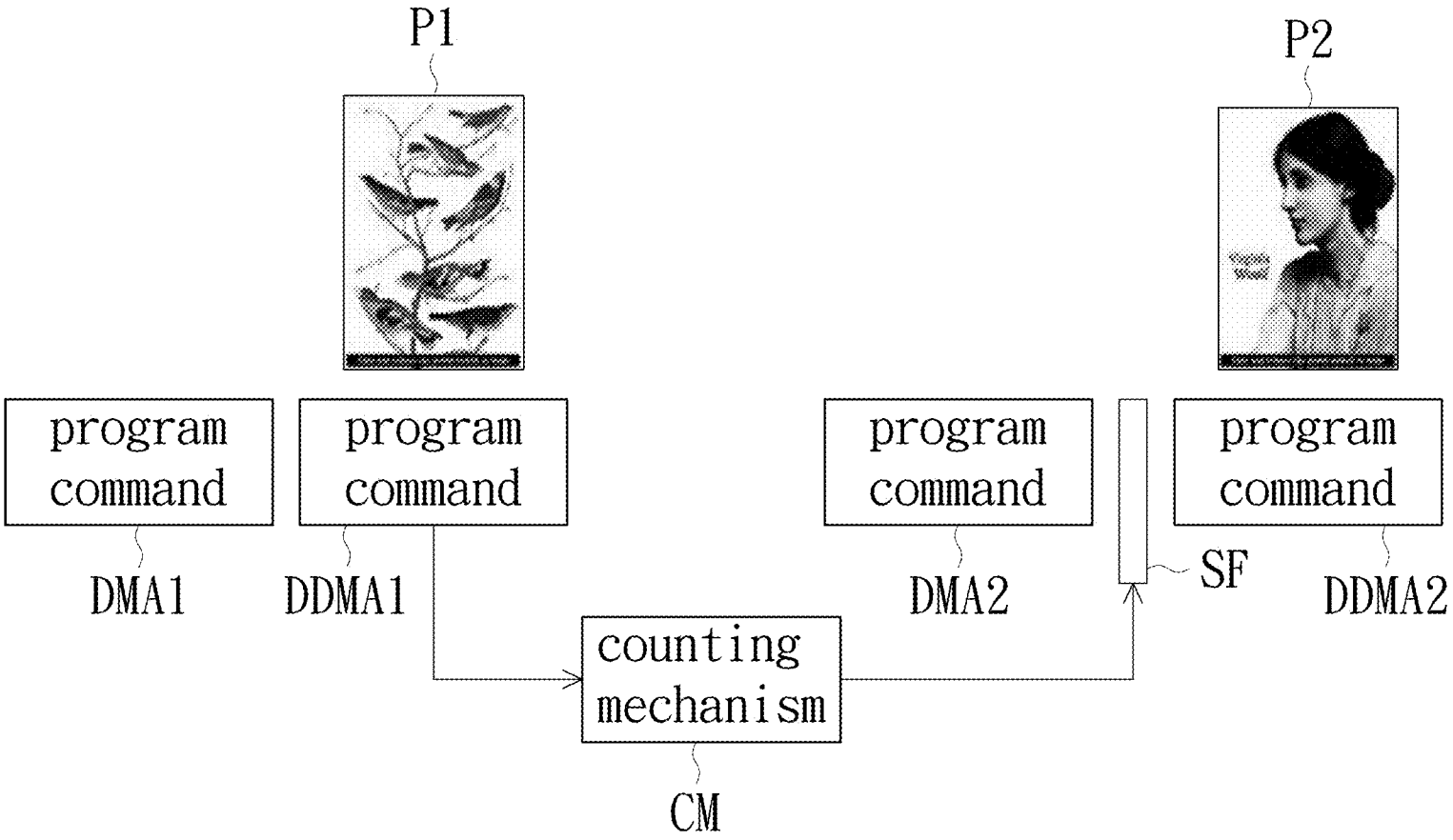
FIG. 2A is a schematic view illustrating a process of the display procedure executed by the display driving circuit in accordance with the embodiment of the present disclosure.

FIG. 2A is a schematic view illustrating a process of the display procedure executed by the display driving circuit 100 in accordance with the embodiment of the present disclosure. Please refer to both FIG. 1 and FIG. 2A. Firstly, the timing control unit 40 executes the first display procedure so as to control the display unit 10 to display the frame P1 thereon. Specifically, the first display procedure is constituted by several individual operation processes of specific program commands (for example, program commands DMA1, DDMA1). In particular, the timing control unit 40 is configured to store the frame data of the frame P1 into the memory unit 50 according to the program command DMA1; and then, the timing control unit 40 is configured to read the frame data of the frame P1 from the memory unit 50 according to the program command DDMA1, and accordingly the readout frame data can be performed by a signal conversion and transmitted to the gate drive unit 20 and/or the source drive unit 30 for displaying. As such, the timing control unit 40 can control the gate drive unit 20 and the source drive unit 30 to output specific scan signals and data signals respectively so as to display the frame P1 on the display unit 10.

The second display procedure is also constituted by several operation process of specific program commands (for example, program commands DMA2, DDMA2) similar to those in the first display procedure. Based on the same manner of operation, the timing control unit 40 is configured to store the frame data of the frame P2 into the memory unit 50 according to the program command DMA2; and then, the timing control unit 40 is configured to read the frame data of the frame P2 from the memory unit 50 according to the program command DDMA2, and accordingly the readout frame data can be performed by a signal conversion and transmitted to the gate drive unit 20 and/or the source drive unit 30 for displaying. As such, the timing control unit 40 can control the gate drive unit 20 and the source drive unit 30 to respectively output specific scan signals and data signals so as to display the frame P2 on the display unit 10.

In this embodiment, it is to be noted that the timing control unit 40 further executes the counting mechanism CM according to the program command DDMA1 and obtain a counting value of the counting mechanism CM according to the program command DMA2. In addition, the timing control unit 40 determines the relationship between the counting value and the predetermined value once the counting value is obtained. As mentioned above, the timing control unit 40, upon determining if the counting value is larger than the predetermined value, firstly executes the specific display procedure SF before the execution of the second display procedure. Each of the counting value and the determined value is corresponding to a time length; specifically, the determined value is e.g. 30 seconds and the counting value is the time between the executions of the two program commands DDMA1, DMA2 (in other words, the counting value is determined based on a user's operation on the display unit 10) in this embodiment. In addition, it is to be noted that the comparison between the counting value and the predetermined value in this embodiment can be realized by commands such as, for example, "if" and "else" of C language, and no limitation.

Figure 2B:
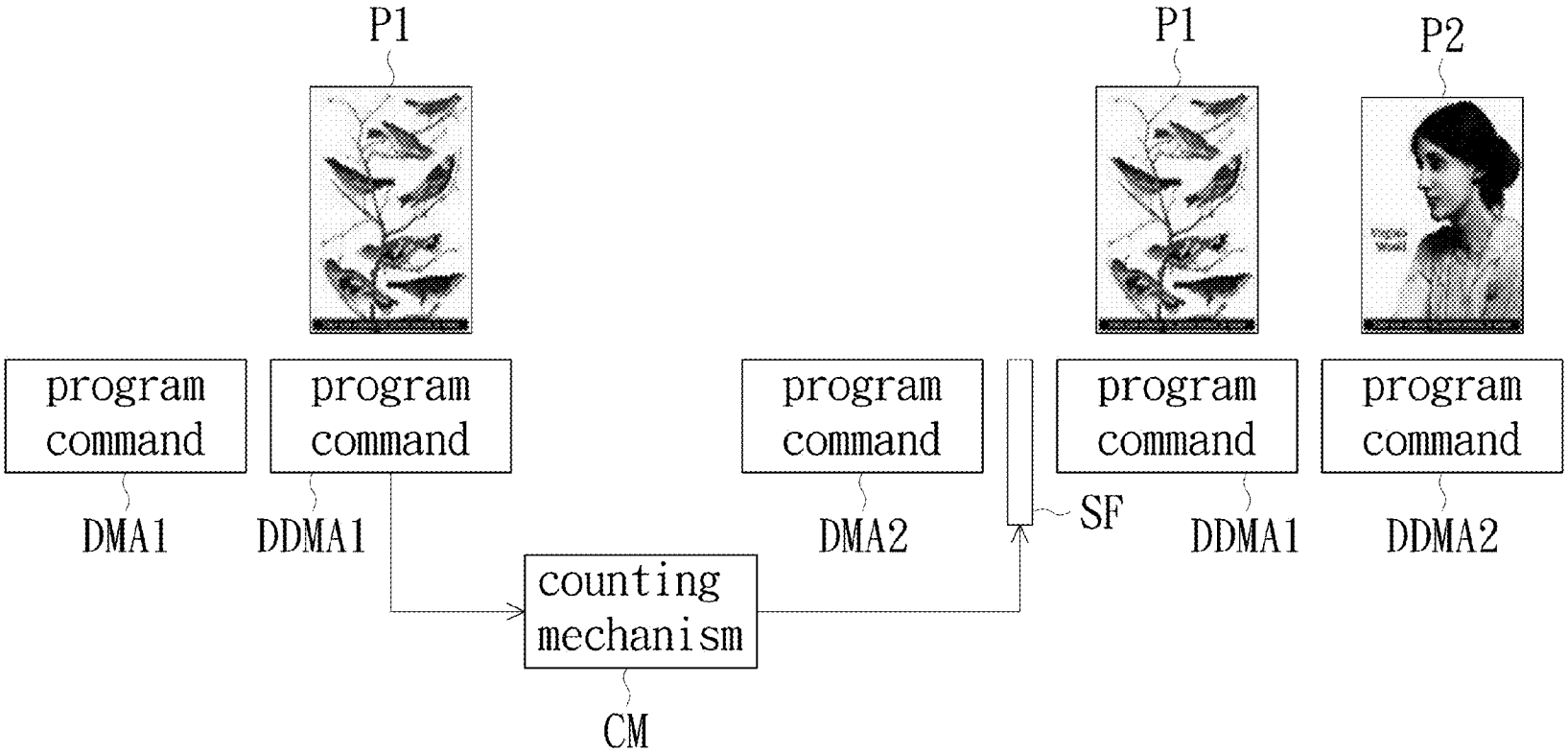
FIG. 2B is a schematic view illustrating a process of the display procedure executed by the display driving circuit in accordance with an embodiment of the present disclosure.

FIG. 2B is a schematic view illustrating a process of the display procedure executed by the display driving circuit 100 in accordance with another embodiment of the present disclosure. Please refer to both FIG. 1 and FIG. 2B. Similarly, the timing control unit 40 firstly executes the first display procedure so as to control the display unit 10 to display the frame P1 thereon; specifically, the timing control unit 40 also executes the counting mechanism CM according to the program command DDMA1 and obtain a counting value of the counting mechanism CM according to the program command DMA2. Then, the timing control unit 40 executes the specific display procedure SF if the counting value is larger than the predetermined value. In this embodiment, the specific display procedure SF includes the following steps: reading the frame data of the frame P1 from the memory unit 50 according to the program command DDMA1; and shortly displaying the frame P1 on the display unit 10.

Afterwards, the timing control unit 40 displays the frame P2 on the display unit 10 according to the program command DDMA2. In this embodiment, because an extra frame P1 is shortly inserted and displayed while the image shown on the display unit 10 is being switched from the frame P1 to the frame P2, the ghost issue can be avoided. In addition, the specific display procedure SF, for displaying a specific frame on the display unit 10 between the frames P1, P2, is configured to have a time length shorter than the time required by the display unit switching the image from the frame P1 to the frame P2; for example, the specific frame can have a displaying length of 1 second.

Figure 2C:
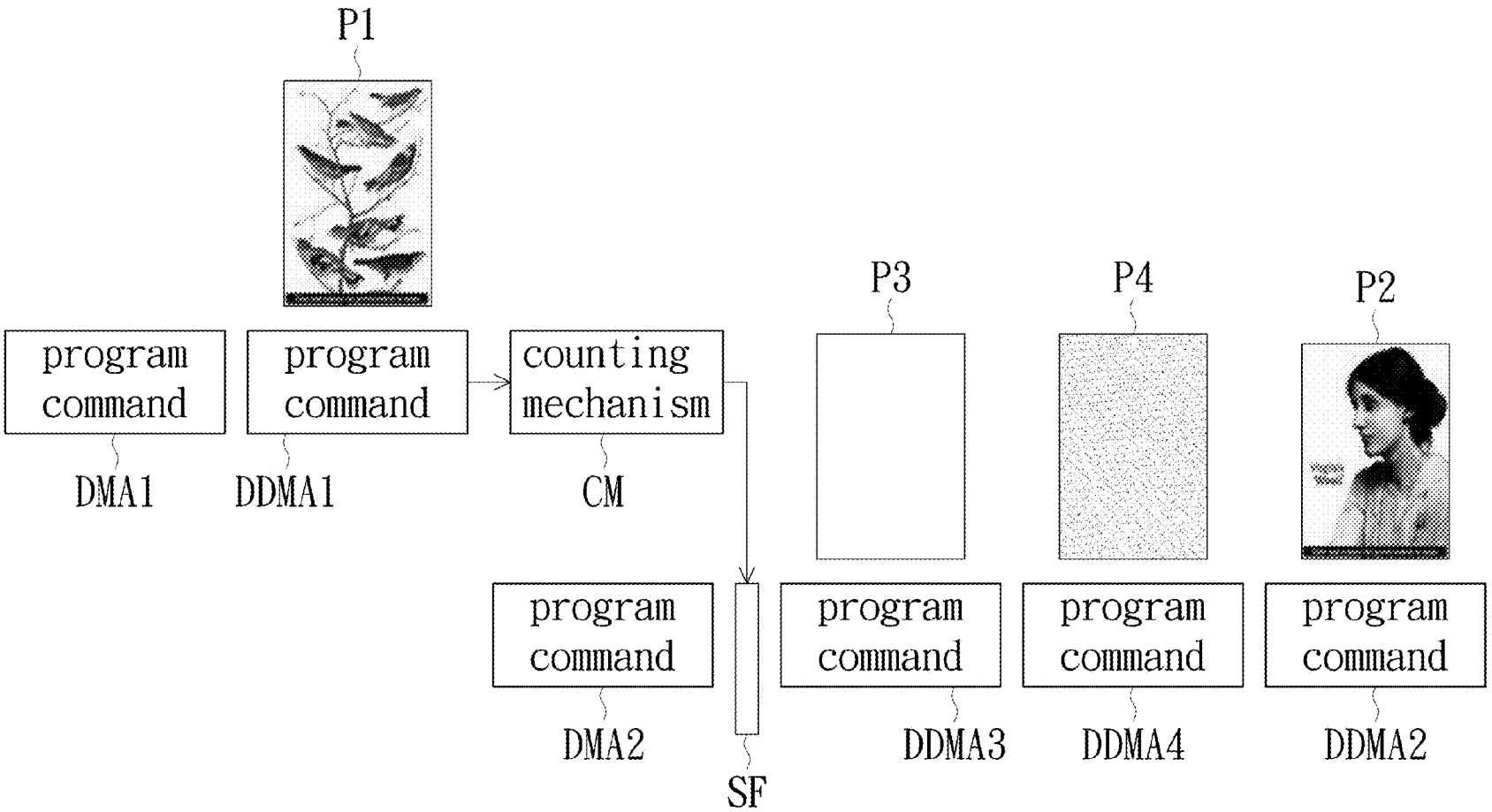
FIG. 2C is a schematic view illustrating a process of the display procedure executed by the display driving circuit in accordance with an embodiment of the present disclosure.

FIG. 2C is a schematic view illustrating a process of the display procedure executed by the display driving circuit 100 in accordance with another embodiment of the present disclosure. Please refer to both FIG. 1 and FIG. 2C. Still, the timing control unit 40 firstly executes the first display procedure so as to control the display unit 10 to display the frame P1 thereon; and no any unnecessary detail will be given here. Then, the timing control unit 40 obtains a counting value of the counting mechanism CM according to the execution of the program command DMA2. Then, the timing control unit 40 executes the specific display procedure SF if the counting value is larger than the predetermined value. In this embodiment, the specific display procedure SF includes the following steps: reading the frame data of the frame P3 (for example, a full-white frame) from the memory unit 50 according to the program command DDMA3 so as to shortly display the frame P3 on the display unit 10; and reading the frame data of the frame P4 (for example, a full-black frame) from the memory unit 50 according to the program command DDMA4 so as to shortly display the frame P3 on the display unit 10. It is understood that the specific display procedure SF in this embodiment can firstly display the frame P4 (for example, a full-black frame) and then display the frame P3 (for example, a full-white frame) on the display unit 10.

The frames P3, P4 each are configured to have a displaying time of 1 second, and no limitation. Afterwards, the timing control unit 40 displays the frame P2 on the display unit 10 according to the program command DDMA2.

Figure 2D:
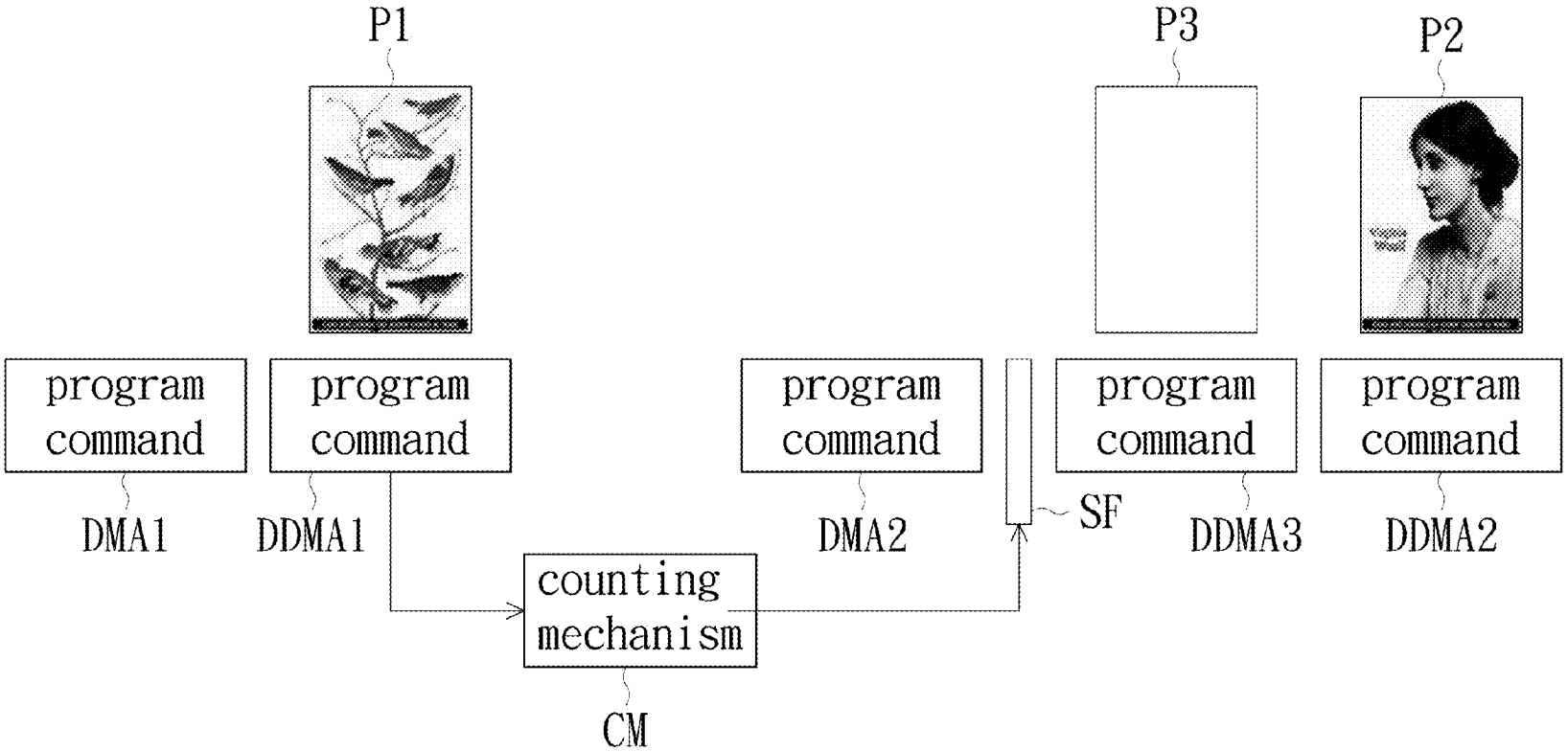
FIG. 2D is a schematic view illustrating a process of the display procedure executed by the display driving circuit in accordance with an embodiment of the present disclosure.

FIG. 2D is a schematic view illustrating a process of the display procedure executed by the display driving circuit 100 in accordance with another embodiment of the present disclosure. Please refer to both FIG. 1 and FIG. 2D. Still, the timing control unit 40 firstly executes the first display procedure so as to control the display unit 10 to display the frame P1 thereon; and no unnecessary detail will be given here. Then, the timing control unit 40 obtains a counting value of the counting mechanism CM according to the execution of the program command DMA2. Then, the timing control unit 40 executes the specific display procedure SF if the counting value is larger than the predetermined value. In this embodiment, the specific display procedure SF includes the following step: reading the frame data of the frame P3 (for example, a full-white frame) from the memory unit 50 according to the program command DDMA3 so as to shortly display the frame P3 on the display unit 10. Afterwards, the timing control unit 40 displays the frame P2 on the display unit 10 according to the program command DDMA2.

Figure 2E:
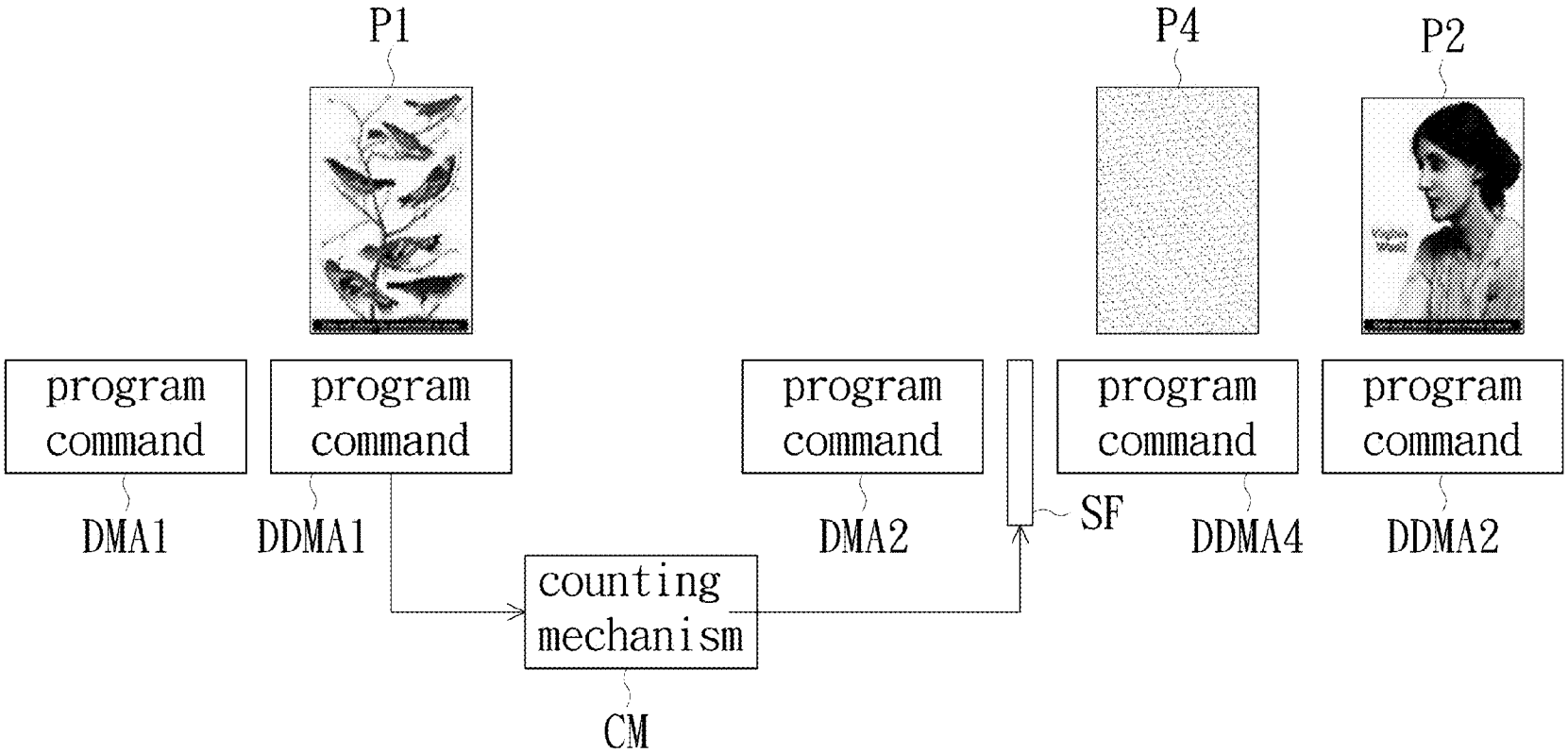
FIG. 2E is a schematic view illustrating a process of the display procedure executed by the display driving circuit in accordance with an embodiment of the present disclosure.

FIG. 2E is a schematic view illustrating a process of the display procedure executed by the display driving circuit 100 in accordance with another embodiment of the present disclosure. Please refer to both FIG. 1 and FIG. 2E. Still, the timing control unit 40 firstly executes the first display procedure so as to control the display unit 10 to display the frame P1 thereon; and no unnecessary detail will be given here. Then, the timing control unit 40 obtains a counting value of the counting mechanism CM according to the execution of the program command DMA2. Then, the timing control unit 40 executes the specific display procedure SF if the counting value is larger than the predetermined value. In this embodiment, the specific display procedure SF includes the following step: reading the frame data of the frame P4 (for example, a full-black frame) from the memory unit 50 according to the program command DDMA4 so as to shortly display the frame P4 on the display unit 10. Afterwards, the timing control unit 40 displays the frame P2 on the display unit 10 according to the program command DDMA2.

Figure 3:
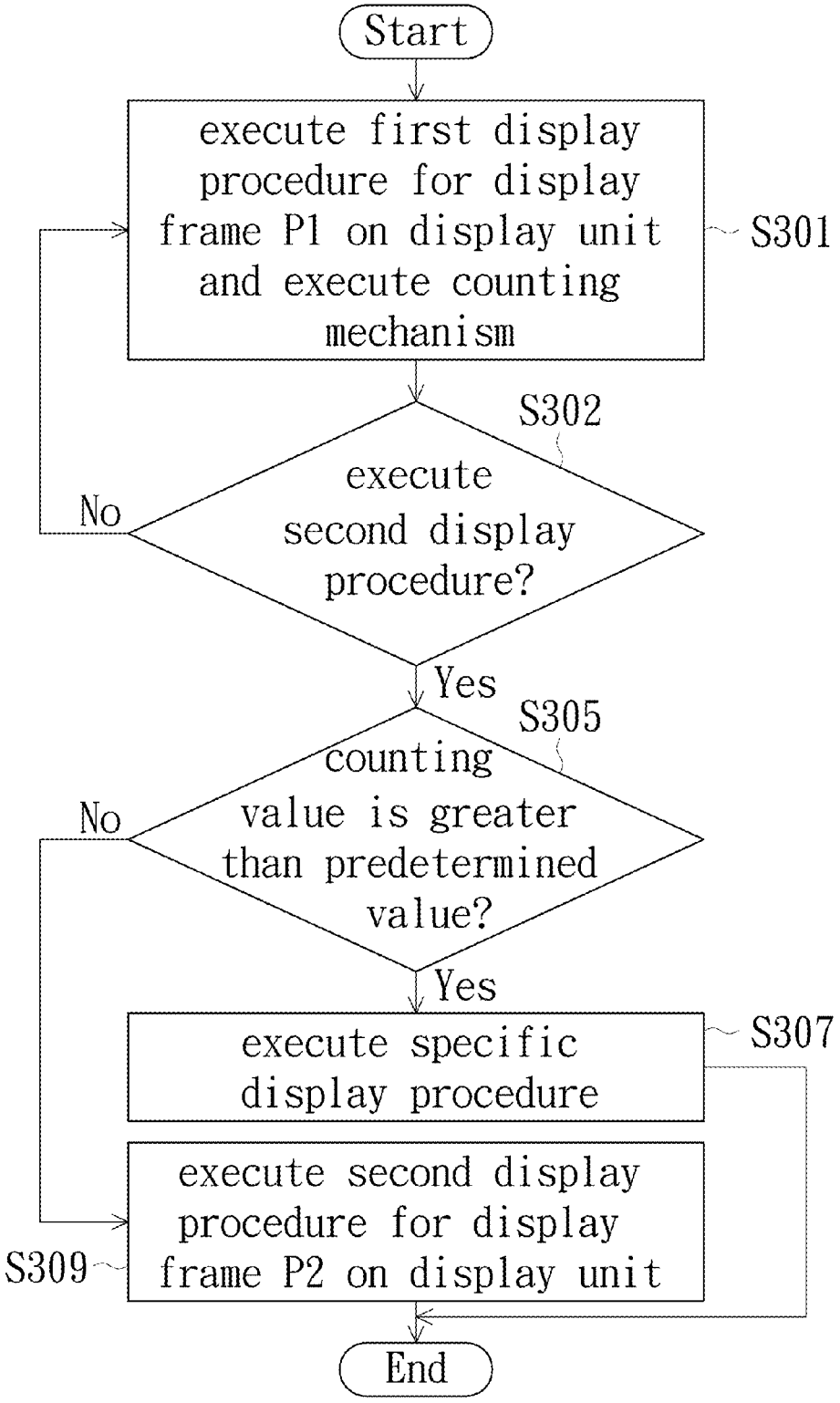
FIG. 3 is a schematic flow chart illustrating a driving method of a display driving circuit in accordance with the embodiment of the present disclosure.

FIG. 3 is a schematic flow chart illustrating a driving method of a display unit in accordance with the embodiment of the present disclosure. Please refer to FIGS. 1, 2A and 3. As shown, the timing control unit 40 executes the first display procedure, for displaying the frame P1 on the display unit 10, and the counting mechanism CM according to the execution of the first display procedure (step S301).

Then, the timing control unit 40 determines whether or not to execute the second display procedure according to the program command DMA2 (step S302). If the program command DMA2 is not required to be executed, the display unit 10 keeps displaying the frame P1 and the counting mechanism CM keeps accumulating the counting value without a resetting.

Alternatively, the timing control unit 40, if the program command DMA2 is confirmed to be executed, determines as to whether or not the counting value is larger than the predetermined value (step S305).

Afterwards, if the counting value is larger than the predetermined value, the timing control unit 40 firstly executes the specific display procedure SF before the execution of the second display procedure (step S307). Alternatively, the driving method goes to step S309 if the counting value is equal to or smaller than the predetermined value. In one embodiment, the specific display procedure SF is configured to read the frame data of the frame P1 from the memory unit 50 according to the program command DDMA1 so as to display the frame P1 on the display unit 10. In another embodiment, the specific display procedure SF is configured to read the frame data of the frame P3 (for example, a full-white frame) from the memory unit 50 according to the program command DDMA3 so as to display the frame P3 on the display unit 10. In another embodiment, the specific display procedure SF is configured to read the frame data of the frame P4 (for example, a full-black frame) from the memory unit 50 according to the program command DDMA4 so as to display the frame P4 on the display unit 10. In another embodiment, the specific display procedure SF is configured to firstly read the frame data of the frame P3 (for example, a full-white frame) from the memory unit 50 according to the program command DDMA3 so as to display the frame P3 on the display unit 10, and then read the frame data of the frame P4 (for example, a full-black frame) from the memory unit 50 according to the program command DDMA4 so as to display the frame P4 on the display unit 10. In another embodiment, the specific display procedure SF is configured to firstly read the frame data of the frame P4 (for example, a full-black frame) from the memory unit 50 according to the program command DDMA4 so as to display the frame P4 on the display unit 10, and then read the frame data of the frame P3 (for example, a full-white frame) from the memory unit 50 according to the program command DDMA3 so as to display the frame P3 on the display unit 10.

Afterwards, the timing control unit 40 executes the second display procedure (specifically, the program command DDMA2) for displaying the frame P2 on the display unit 10 (step S309). Specifically, the program command DDMA2 for displaying the frame P2 on the display unit 10 is executed only when the specific display procedure SF is completed.

In addition, it is to be noted that the frames P3, P4 can be referred to as a compensating image; wherein the frames P3, P4 each are a full-white or a full-black image. Moreover, the program commands DDMA3, DDMA4, for displaying the frames P3, P4 respectively, can be referred to as a compensating signal.

In summary, because a specific frame(s) (for example, a previous frame, a full-white frame and/or a full-black frame) is inserted and displayed while the display unit is performing an image switching, the driving method and the display driving circuit according to the embodiments of the present disclosure can avoid the ghost issue and consequently have an improved display quality.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A driving method of a display unit comprising:

executing a first display procedure, for displaying a first frame on the display unit, and executing a counting mechanism;

determining, if a second display procedure for displaying a second frame on the display unit is confirmed to be executed, whether or not a counting value of the counting mechanism is larger than a predetermined value;

executing a specific display procedure before the second display procedure being executed if the counting value is larger than the predetermined value; and executing the second display procedure without the specific display procedure if the counting value is equal to or smaller than the predetermined value;

wherein the counting value and the predetermined value each corresponds to a time length, the counting value is a display duration of the first frame.

2. The driving method according to claim 1, wherein the first display procedure comprises:

storing a first frame data in a memory unit according to a first program command; and reading the first frame data from the memory unit according to a second program command so as to display the first frame on the display unit;

the second display procedure comprises:

storing a second frame data in the memory unit according to a third program command; and reading the second frame data from the memory unit according to a fourth program command so as to display the second frame on the display unit.

3. The driving method according to claim 2, wherein the counting mechanism is executed according to the execution of the second program command, and the counting value of the counting mechanism is obtained according to the execution of the third program command.

4. The driving method according to claim 2, wherein the specific display procedure comprises:

reading the first frame data from the memory unit according to the second program command so as to display the first frame on the display unit.

5. The driving method according to claim 2, wherein the specific display procedure comprises:

reading a full-white frame data or a full-black frame data from the memory unit according to a fifth program command so as to display a full-white frame or a full-black frame on the display unit, respectively.

6. The driving method according to claim 2, wherein the specific display procedure comprises:

reading a full-white frame data from the memory unit according to a fifth program command so as to display a full-white frame on the display unit; and reading a full-black frame data from the memory unit according to a sixth program command so as to display a full-black frame on the display unit.

7. The driving method according to claim 2, wherein the specific display procedure comprises:

reading a full-black frame data from the memory unit according to a fifth program command so as to display a full-black frame on the display unit; and reading a full-white frame data from the memory unit according to a sixth program command so as to display a full-white frame on the display unit.

8. The driving method according to claim 1, wherein the specific display procedure is configured to display a specific frame configured to have a displaying length shorter than the time required for an image switching from the first frame to the second frame on the display unit.

9. A display driving circuit, comprising:

a gate drive unit configured to provide at least a scan signal;

a source drive unit configured to provide at least a data signal;

a display unit electrically coupled to the gate drive unit and the source drive unit and configured to display a corresponding frame according to the scan signal(s) and the data signal(s); and a timing control unit electrically coupled to the source drive unit and configured to control the source drive unit to provide the data signal(s), execute a first display procedure for displaying a first frame on the display unit and execute a counting mechanism;

wherein the timing control unit determines, before a second display procedure for displaying a second frame on the display unit is confirmed to be executed, whether or not a counting value of the counting mechanism is larger than a predetermined value, the counting value and the predetermined value each corresponds to a time length, the counting value is a display duration of the first frame;

wherein the timing control unit sequentially executes a specific display procedure before the second display procedure is executed if the counting value is larger than the predetermined value;

wherein the timing control unit directly executes the second display procedure without the specific display procedure if the counting value is equal to or smaller than the predetermined value.

10. The display driving circuit according to claim 9, further comprising:

a memory unit electrically coupled to the timing control unit and configured to store a first frame data of the first frame and a second frame data of the second frame;

wherein the timing control unit controls the display unit to display the first and second frames according to the first and second frame data stored in the memory unit, respectively.

11. The display driving circuit according to claim 9, wherein the first display procedure comprises:

storing a first frame data of the first frame into a memory unit according to a first program command; and reading the first frame data from the memory unit according to a second program command so as to display the first frame on the display unit;

the second display procedure comprises:

storing a second frame data of the second frame into the memory unit according to a third program command; and reading the second frame data from the memory unit according to a fourth program command so as to display the second frame on the display unit.

12. The display driving circuit according to claim 11, wherein the counting mechanism is executed according to the execution of the second program command, and the counting value of the counting mechanism is obtained according to the execution of the third program command.

13. The display driving circuit according to claim 11, wherein the specific display procedure comprises:

reading the first frame data from the memory unit according to the second program command so as to display the first frame on the display unit.

14. The display driving circuit according to claim 11, wherein the specific display procedure comprises:

reading the full-white frame data or the full-black frame data from the memory unit according to a fifth program command so as to display a full-white frame or a full-black frame on the display unit, respectively.

15. The display driving circuit according to claim 9, wherein the specific display procedure is configured to display a specific frame configured to have a displaying length shorter than the time required for an image switching from the first frame to the second frame on the display unit.

16. A driving method of a display unit comprising:

displaying a first image;

accumulating a counting value when the first image is being displayed; and delivering a compensating signal when the counting value is larger than a predetermined value;

wherein the counting value and the predetermined value each corresponds to a time length, the counting value is a display duration of the first frame.

17. The driving method according to claim 16, further comprising:

displaying a compensating image according to the compensating signal.

18. The driving method according to claim 17, wherein the compensating image is a full-white image or a full-black image.

19. The driving method according to claim 16, further comprising:

displaying a second image if the counting value is equal to or smaller than the predetermined value.

* * * * *